US005520017A

United States Patent [19]

Vivat

[11] Patent Number: 5,520,017

[45] Date of Patent: May 28, 1996

[54] JEWELRY ITEMS WITH INVISIBLE GEMSTONE SETTINGS AND METHODS OF ASSEMBLY THEREFORE

[75] Inventor: Oren Vivat, 157 Dizengoff St., Tel Aviv, Israel

[73] Assignees: Oren Vivat; Alon Vivat, both of Tel Aviv, Israel

[21] Appl. No.: 378,214

[22] Filed: Jan. 25, 1995

[51] Int. Cl.[6] ..... A44C 17/02

[52] U.S. Cl. ..... 63/29.1; 63/28

[58] Field of Search ..... 63/26, 28, 29.1

[56] References Cited

U.S. PATENT DOCUMENTS

| | | | |
|---|---|---|---|
| 4,195,493 | 4/1980 | Bogner et al. . | |
| 5,036,682 | 8/1991 | Kennedy | 63/26 |
| 5,072,601 | 12/1991 | Slowinski | 63/28 |
| 5,123,265 | 6/1992 | Ramot | 63/28 |

FOREIGN PATENT DOCUMENTS

| | | | |
|---|---|---|---|
| 276183 | 7/1988 | European Pat. Off. | 63/26 |
| 276184 | 7/1988 | European Pat. Off. | 63/26 |
| 527111 | 2/1993 | European Pat. Off. | 63/26 |
| 764966 | 3/1934 | France | 63/26 |

*Primary Examiner*—Michael J. Milano
*Attorney, Agent, or Firm*—Mark M. Friedman

[57] ABSTRACT

A jewelry item having an invisible gemstone setting and a method of assembly therefore. The jewelry item includes a gemstone region formed with a recess and a gemstone setting piece having at least two walls defining an open ended groove therebetween for slidably receiving at least one gemstone. The gemstone setting piece is dimensioned so as to be receivable within the recess so as to provide an invisible gemstone setting. The method includes the steps of providing a gemstone region with a recess, providing a gemstone setting piece with at least two walls for defining an open ended groove, sliding at least one gemstone into the open ended groove, inserting the gemstone setting piece into the recess and securing the gemstone setting piece within the gemstone region.

10 Claims, 4 Drawing Sheets

JEWELRY ITEMS WITH INVISIBLE GEMSTONE SETTINGS AND METHODS OF ASSEMBLY THEREFORE

FIELD AND BACKGROUND OF THE INVENTION

The present invention relates to jewelry items with invisible gemstone settings in general and invisible diamond settings in particular.

The term "invisible gemstone setting" is known in the art and refers to a setting of gemstones in which the setting lies beneath the visible surface of the gemstones. To "invisibly" set a large number of gemstones, the approach of the prior art has been to notch the gemstones and to mount them in a setting having two or more parallel walls, with metallic projections, for example, prongs or the like, protruding from these walls for intergaging the notches. Typically, these walls define channels in which the gemstones are set abutting one another in accordance with the invisible mounting method.

To better illustrate the approach of the prior art, a conventional invisible diamond setting within a ring is now described with reference to FIGS. 1–4. FIG. 1 illustrates a ring 10 with an invisible diamond setting 12 made up of a matrix of several rows and columns of diamonds 14. FIG. 2 illustrates that diamonds 14 are inserted in grooves 16 defined by walls 18 prepared in a gemstone region 20 of ring 10. Grooves 16 are either parallel to the short axis of gemstone region 20 as shown in FIG. 3 or the long axis of gemstone region 20 as shown in FIG. 4. Walls 18 are cut so as to prepare a T-shaped cross bar 22 having prongs 24 for intergaging cut-outs 26 formed beneath girdle 28 of diamonds 14 so as to secure diamonds 14 in invisible diamond setting 12. Grooves 16 preferably extend through the plane of gemstone region 20 such that tips 30 of diamonds 14 overlie holes 32 for improving the brilliance of diamonds 14.

The conventional method of assembling a jewelry item with an invisible diamond setting requires the following steps: First, opening an end of gemstone region 20. Second, sliding a row or column of diamonds 14 along grooves 16 so as to fill up gemstone region 20 from its closed end. Thirdly, tapping lip 34 of gemstone region 20 so as to secure the last row or column of diamonds 14 inserted therewithin. Repeating these steps for all the rows or columns until the jewelry item is completed at which time the opened end of gemstone region 20 is closed and jewelry item 10 is polished so as to ensure a smooth surround to invisible diamond setting 12.

A conventional invisible gemstone setting jewelry item suffers from a number of disadvantages. First, casting of a jewelry item with a gemstone region including a recess and walls and preparing T-shaped cross bars is a relatively difficult and therefore costly process. Second, the assembly of the jewelry item requires considerable time of a skilled worker which adds greatly to the overall cost of the jewelry item. And third, the finished jewelry item cannot be readily downsized without disturbing the invisible gemstone setting.

Therefore, there is a need for novel invisible gemstone setting jewelry items which overcomes the disadvantages of conventional invisible gemstone setting jewelry items. Furthermore, there is a need for a mass production technique of assembling jewelry items with invisible gemstone settings so as to reduce the high cost of labor in the assembly of such jewelry items.

SUMMARY OF THE INVENTION

The object of the present invention is novel invisible gemstone setting jewelry items and methods of assembly therefore.

Hence, there is provided according to the teachings of the present invention, a jewelry item comprising: (a) a gemstone region formed with a recess; and (b) a gemstone setting piece having at least two walls defining an open ended groove therebetween for slidably receiving at least one gemstone, the gemstone setting piece dimensioned so as to be receivable within the recess so as to provide an invisible gemstone setting.

According to a further feature of the present invention, the recess extends through the plane of the gemstone region.

According to a still further feature of the present invention, the gemstone setting piece has a substantially rectangular configuration having a major axis and a minor axis, the walls being substantially parallel to the minor axis.

According to a yet still further feature of the present invention, the gemstone setting piece has a substantially circular configuration and the walls extend substantially radially from the gemstone setting piece.

According to a yet still further feature of the present invention, the gemstone setting piece includes at least one channel substantially orthogonal to the groove such that a hole is formed at the juncture between the open ended groove and the at least one channel.

According to a yet still further feature of the present invention, the gemstone setting piece is made from the same material as the gemstone region.

According to a yet still further feature of the present invention, the gemstone setting piece is made from different material than the gemstone region.

There is also provided according to the teachings of the present invention, a method of assembling a jewelry item comprising the steps of: (a) providing a gemstone region with a recess; (b) providing a gemstone setting piece with at least two walls for defining an open ended groove; (c) sliding at least one gemstone into the open ended groove; (d) inserting the gemstone setting piece into the recess; and (e) securing the gemstone setting piece within the gemstone region.

According to a further feature of the present invention, the gemstone setting piece is cut from a master gemstone setting piece.

According to a still further feature of the present invention, the gemstone setting piece is prepared by milling a bar of material so as to provide the open ended groove.

There is still further provided according to the teachings of the present invention, a jewelry item comprising: (a) a gemstone setting piece having at least two walls defining an open ended groove for slidingly receiving at least one gemstone; and (b) an end plate for sealing the open ended groove.

According to a further feature of the present invention, the jewelry item further comprising a second end plate for sealing a second end of the open ended grooves.

According to a still further feature of the present invention, the gemstone setting piece has a substantially rectangular configuration having a major axis and a minor axis, the walls being substantially parallel to the minor axis.

According to a yet still further feature of the present invention, the gemstone setting piece has a substantially circular configuration and the walls extend substantially radially from the gemstone setting piece.

According to a yet still further feature of the present invention, the gemstone setting piece includes at least one channel substantially orthogonal to the groove such that a hole is formed at the juncture between the open ended groove and the at least one channel.

According to a yet still further feature of the present invention, the end plate is made from the same material as the gemstone setting piece.

According to a yet still further feature of the present invention, the end plate is made from different material than the gemstone setting piece.

BRIEF DESCRIPTION OF THE DRAWINGS

The invention is herein described, by way of example only, with reference to the accompanying drawings, in which similar reference numbers have been employed throughout to designate corresponding parts, wherein.

DESCRIPTION OF THE PREFERRED EMBODIMENTS

Figure 1:
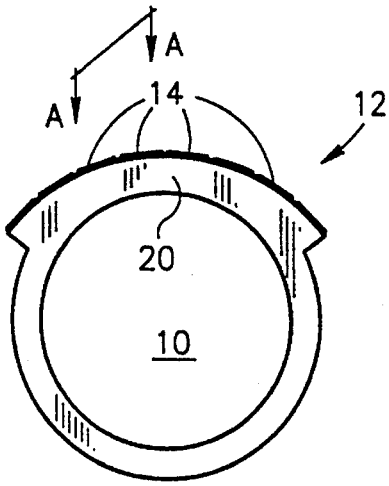
FIG.1 (PRIOR ART)
FIG. 1 shows a perspective view of a conventional invisible gemstone setting jewelry item fashioned as a ring.
Figure 2:
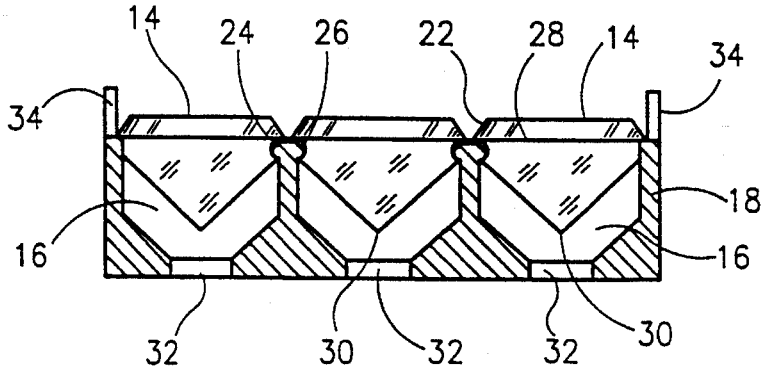
FIG.2 (PRIOR ART)
FIG. 2 shows a cross sectional view of the ring of FIG. 1 along line A—A.
Figure 3:
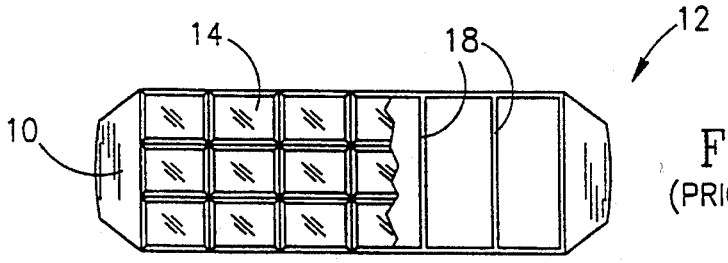
FIG.3 (PRIOR ART)
FIG. 3 shows a top view of a gemstone region with grooves parallel to its short axis.
Figure 4:
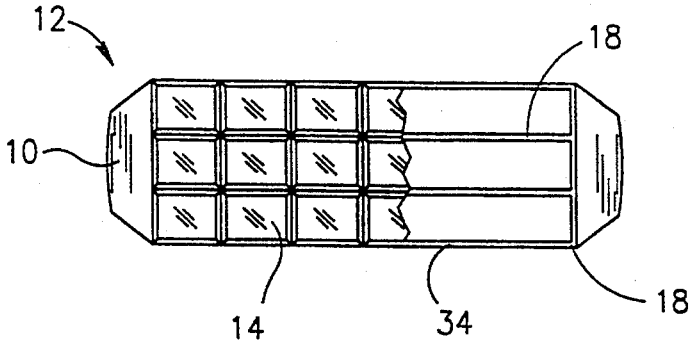
FIG.4 (PRIOR ART)
FIG. 4 shows a top view of a gemstone region with grooves parallel to its long axis.
Figure 5:
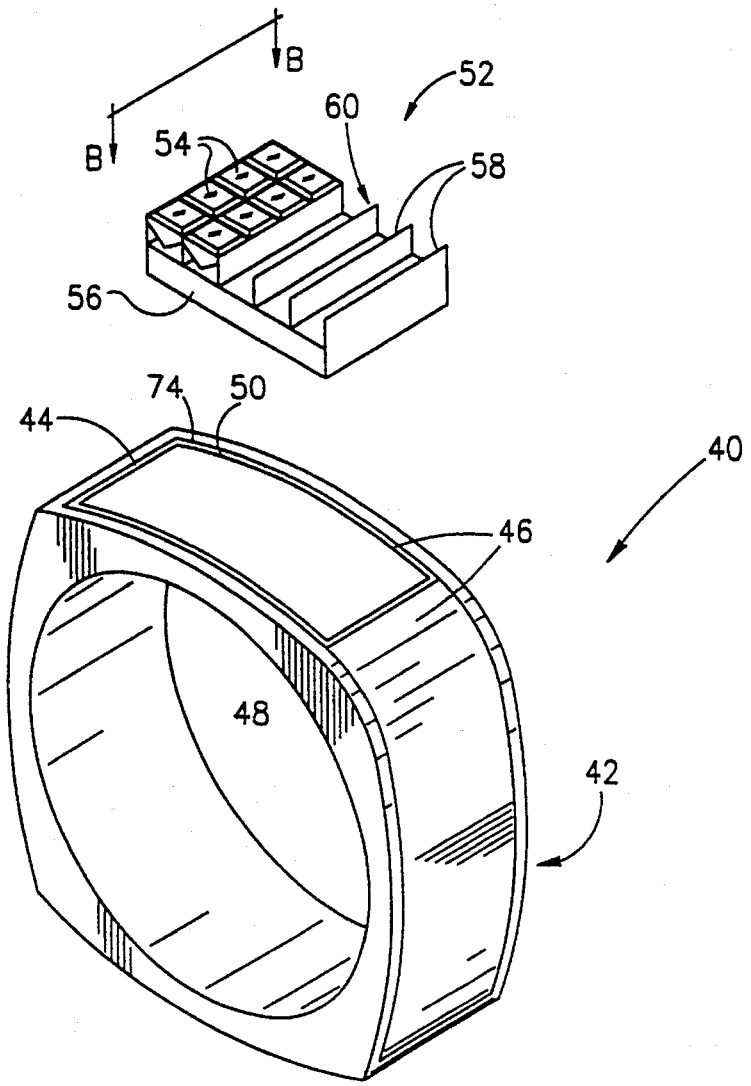
FIG. 5 shows a disassembled view of a jewelry item with a gemstone region and a gemstone setting piece set within the gemstone region according to the teachings of the present invention.
Figure 6:
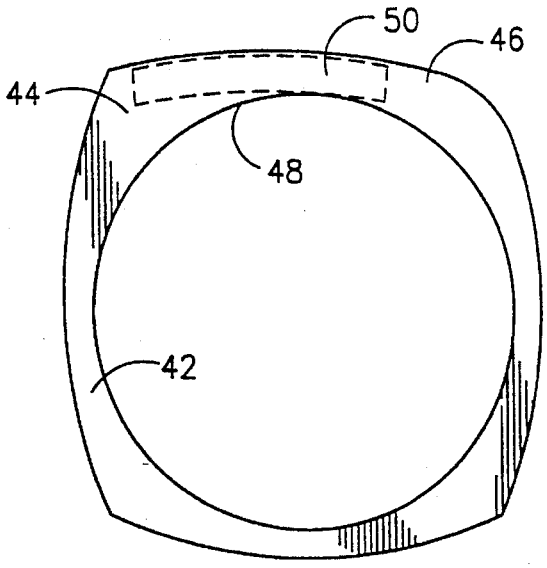
FIG. 6 shows a cross sectional view of the jewelry item of FIG. 5 along line B—B.

The present invention is of jewelry items with invisible gemstone setting and methods of assembly therefore.

The principles of the jewelry items of the present invention may be better understood with reference to the drawings and the accompanying description.

Briefly stated, the jewelry items of the present invention employ two or more discrete components which are processed to form a single jewelry item. As will become evident hereinbelow, the assembly of jewelry items from two or more discrete components modifies the assembly of jewelry items from an item by item production process to a mass production process so as to achieve a far quicker and less expensive assembly process which can largely be performed by non-skilled labor.

One of the components of each jewelry item is configured to receive a plurality of gemstones and is therefore referred to hereinbelow as the "gemstone setting piece". The gemstone setting piece includes parallel walls which define open ended grooves therebetween for receiving gemstones slided into the grooves from one end. The gemstone setting pieces are modular pieces which can be set in a wide range of jewelry items prepared with a gemstone region dimensioned to receive a gemstone setting piece.

The gemstone setting piece typically has one of two configurations: First, a generally rectangular configuration having a major axis and a minor axis in which case the walls are parallel to the minor axis. And second, a generally circular configuration in which case the walls are radial. It should be noted that in both cases the walls are preferably deployed such that the grooves extend along the shorter dimension of the two dimensions of the gemstone setting piece so as to minimize the number of gemstones which are required to be slided into the grooves.

Referring now to the drawings, FIGS. 5–9 depict a jewelry item, generally designated 40, constructed according to the teachings of the present invention. For the sake of exposition only, jewelry item 40 is fashioned as an item designed to be worn by a user, in this case, a ring. Obviously, jewelry item 40 can be fashioned as other items designed to be worn by a user, for example, a bracelet, a necklace, a wristwatch, and the like. Still again, jewelry item 40 can be fashioned as any one of a wide range of personal or household items, for example, a cigarette case, a vanity box, and the like.

Ring 40 is configured as a circlet 42 with a gemstone region 44 having an upper exposed surface 46 and a lower concealed surface 48 which contacts a wearer. Gemstone region 44 includes a recess 50 which preferably extends therethrough from upper exposed surface 46 through to lower concealed surface 48. It is a particular feature of the present invention that a gemstone setting piece 52 carrying a matrix of diamonds 54 is dimensioned so as to fit snugly in recess 50. Hence, it can be readily appreciated that ring 40 is assembled from two discrete components: circlet 42 with gemstone region 44 and gemstone setting piece 52. Furthermore, it can be readily appreciated that gemstone setting piece 52 can be made from the same material as circlet 42 or from different material.

Gemstone setting piece 52 includes a base portion 56 and a series of parallel walls 58 which define open ended grooves 60 therebetween for receiving diamonds 54. Gemstone setting piece 52 includes at least two walls 58 so as to provide at least one groove 60. Grooves 60 are preferably open ended at both ends, however, it is sufficient that they be open at just the one end so as to enable the sliding insertion of diamonds 54 thereinto.

As described with reference to the conventional invisible diamond setting 12, walls 58 preferably have a T-shaped cross bar 62 having prongs 64 intergaging cut-outs 66 formed in diamonds 54. Alternatively, diamonds 54 can be fashioned with sharply pointed edges as described in U.S. Pat. No. 5,072,601 to Slowinski, thereby obviating the need for T-shaped cross bar 62.

Figure 7:
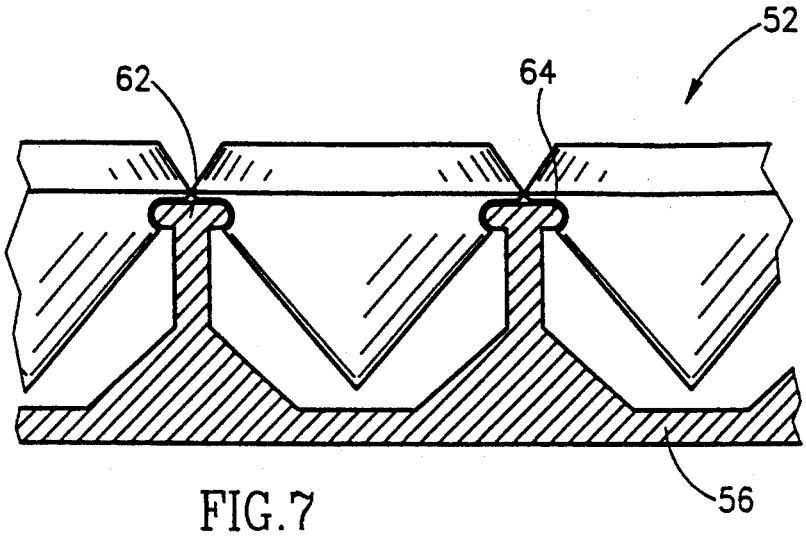
FIG. 7 shows a side view of a rectangular gemstone setting piece.
Figure 8:
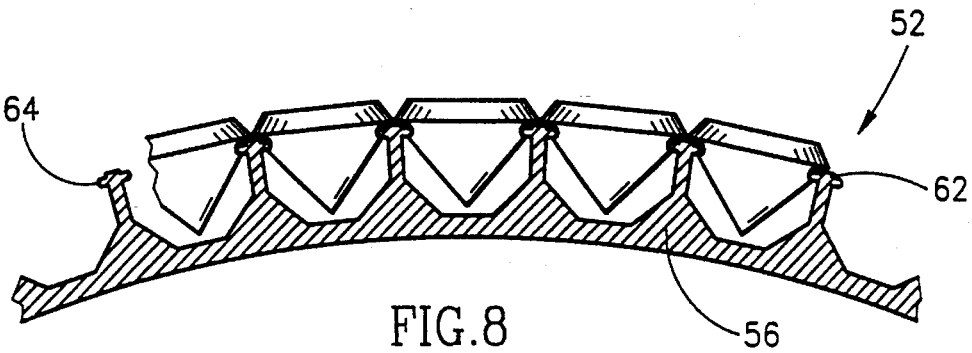
FIG. 8 shows a side view of a circular gemstone setting piece.

Gemstone setting piece 52 typically has one of two configurations: First, a generally rectangular configuration having a major axis and a minor axis in which case walls 58 are parallel to the minor axis as shown in FIG. 7. And second, a generally circular configuration in which case walls 58 are radial as shown in FIG. 8. It should be noted that in both cases walls 58 are preferably deployed such that open ended grooves 60 extend along the shorter axis of the two dimensions of recess 50.

Figure 9:
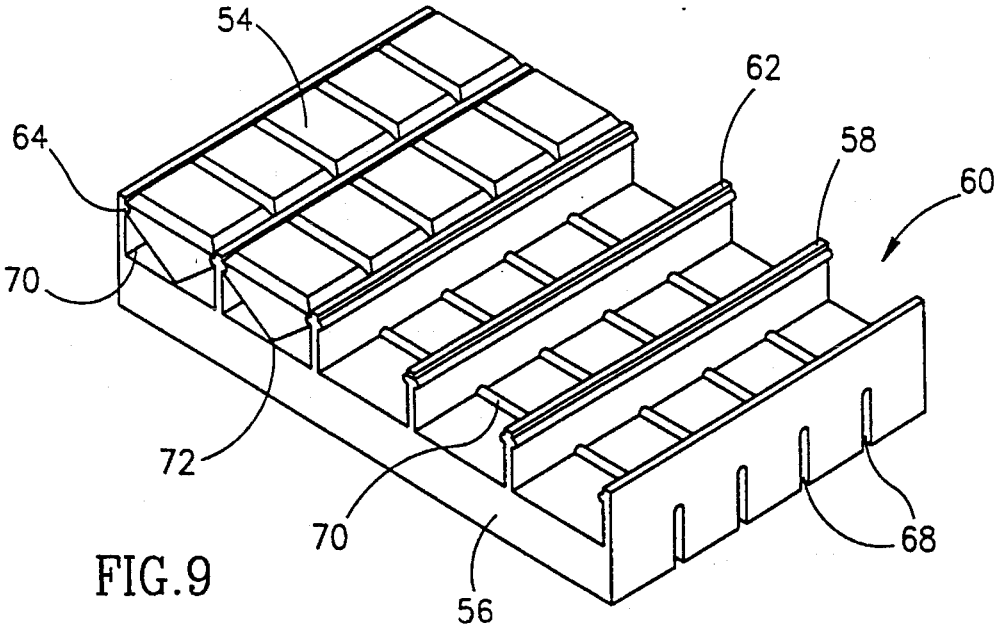
FIG. 9 shows a perspective view of a channel in a gemstone setting piece deployed so as to make holes at the junctures between the channel and the grooves.

With reference now to FIG. 9, it is a further feature of gemstone setting piece 52 that base portion 56 includes one or more channels 68 deployed orthogonally to open ended grooves 60 and of sufficient depth such that apertures 70 are formed at the juncture between a groove 60 and a channel 68. The spacing between channels 68 is determined such that tips 72 of diamonds 54 directly overlie apertures 70 so as to improve the brilliance of diamonds 54 in a similar fashion to conventional invisible diamond setting 12. Alternatively, holes can be prepared by drilling in base portion 56 in place of channels 68.

The method of assembly of jewelry item 40 is now described. First, preparing gemstone region 44 and recess 50 in accordance with the desired design of jewelry item 40. Second, preparing gemstone setting piece 52 by slidingly inserting a row or column of diamonds 54 into a row or column of grooves from one of the open ends of grooves 60. Third, deploying gemstone setting piece 52 within recess 50. Fourth, securing gemstone setting piece 52 within gemstone region 44 by typically tapping down lip 74 of recess 50. And lastly, polishing and otherwise finishing jewelry item 40.

Typically, gemstone setting piece 52 is cut from a master gemstone setting piece according to the desired size. In this case, diamonds 54 are preferably set into master gemstone setting piece before it is cut into the required gemstone setting pieces. Hence, the master gemstone setting piece acts, in effect, as a rack of diamonds. The master gemstone setting piece is preferably prepared by milling a solid bar of metal at predetermined intervals so as prepare the grooves.

It will be noted that the proposed method for assembly of jewelry items includes several important advantages over the conventional method of assembly. First, the casting of jewelry item is less complicated without the T-shaped cross bars. Second, the sliding insertion of diamonds into grooves of master gemstone setting piece is far quicker then the sliding insertion into jewelry item 10 and can be performed by non-skilled labor. Third, the master gemstone setting piece can be sufficient for a large number of gemstone setting pieces such that in effect the insertion of diamonds has been transformed into a mass production of such gemstone setting pieces. And lastly, the hammering of the lip of the recess down to secure gemstone setting piece in place is performed for all of lip rather than for each individual row or column of diamonds.

Figure 10:
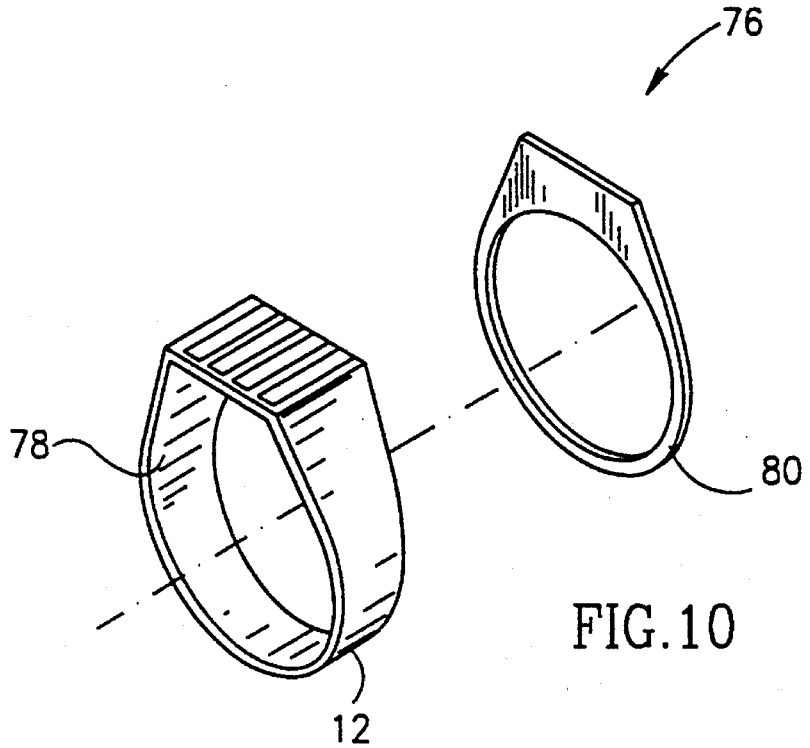
FIGS. 10 and 11 show perspective views of jewelry items employing the gemstone setting piece of the present invention.
Figure 11:
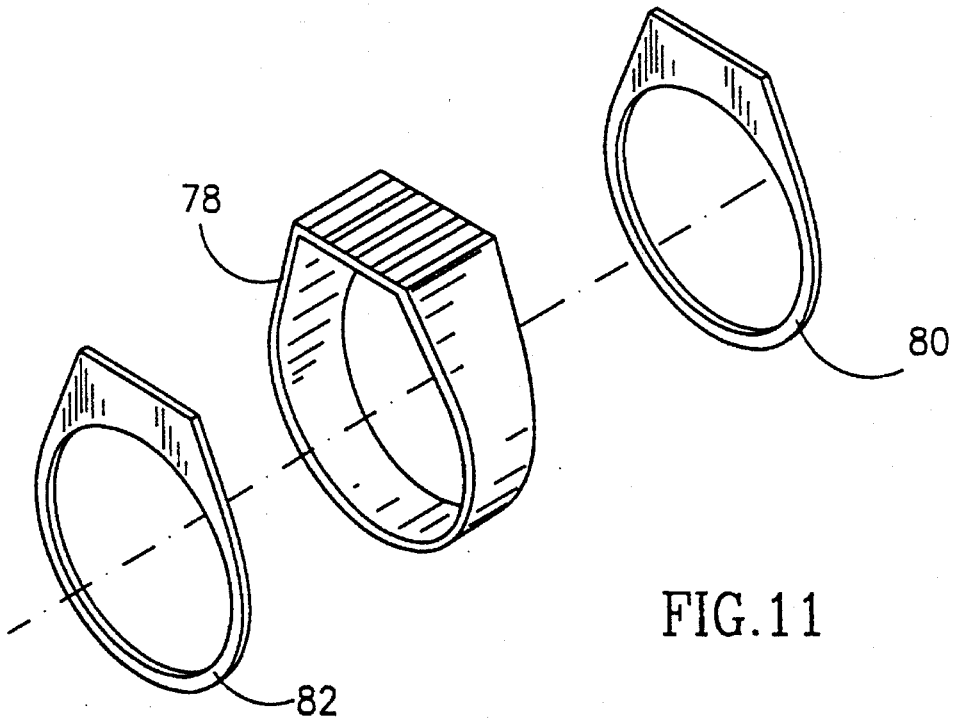

With reference now to FIGS. 10 and 11, a second embodiment of a jewelry item, generally designated 76, assembled from a number of discrete components according to the teachings of the present invention is now described. In this case, jewelry item 76 includes a gemstone setting piece 78 as described hereinabove and an end plate 80 for sealing the open end of grooves with only one open end (see FIG. 10). In the instance that grooves are open ended at both ends, then jewelry item 76 includes a second end plate 82 for sealing the second end of the grooves (see FIG. 11).

While the invention has been described with respect to a limited number of embodiments, it will be appreciated that many variations, modifications and other applications of the invention may be made.

What is claimed is:

1. A jewelry item comprising:

(a) a gemstone region formed with a recess; and (b) a gemstone setting piece having at least two walls defining an open ended groove therebetween for slidably receiving at least one gemstone, said gemstone setting piece received within said recess so as to provide an invisible gemstone setting.

2. The jewelry item as in claim 1 wherein said recess extends through the plane of said gemstone region.

3. The jewelry item as in claim 1 wherein said gemstone setting piece has a substantially rectangular configuration having a major axis and a minor axis, said walls being substantially parallel to said minor axis.

4. The jewelry item as in claim 1 wherein said gemstone setting piece has a substantially circular configuration and said walls extend substantially radially from said gemstone setting piece.

5. The jewelry item as in claim 1 wherein said gemstone setting piece includes at least one channel substantially orthogonal to said groove such that a hole is formed at the juncture between said open ended groove and said at least one channel.

6. The jewelry item as in claim 1 wherein said gemstone setting piece is made from the same material as said gemstone region.

7. The jewelry item as in claim 1 wherein said gemstone setting piece is made from different material than said gemstone region.

8. A method of assembling a jewelry item comprising the steps of (a) providing a gemstone region with a recess;

(b) providing a gemstone setting piece with at least two walls for defining an open ended groove;

(c) sliding at least one gemstone into the open ended groove;

(d) inserting the gemstone setting piece into the recess; and (e) securing the gemstone setting piece within the gemstone region.

9. The method as in claim 8 wherein the gemstone setting piece is cut from a master gemstone setting piece.

10. The method as in claim 8 wherein gemstone setting piece is prepared by milling a bar of material so as to provide the open ended groove.

* * * * *